United States Patent [19]

Bratton et al.

[11] Patent Number: 4,816,014

[45] Date of Patent: Mar. 28, 1989

[54] CARTON HANDLE APPLICATOR

[75] Inventors: Charles W. Bratton, West Monroe; James D. McPherson; Delbert D. Williams, Jr., Both of Monroe, all of La.

[73] Assignee: Manville Corporation, Denver, Colo.

[21] Appl. No.: 94,227

[22] Filed: Sep. 8, 1987

[51] Int. Cl.[4] ..... B31B 1/86

[52] U.S. Cl. ..... 493/88; 493/123; 493/131; 493/334; 493/379; 493/909; 271/184; 271/276

[58] Field of Search ..... 493/88, 96, 110, 117, 493/120, 123, 131, 221, 334, 379, 905, 909; 271/184, 185, 276; 156/514, 571, 567, 568

[56] References Cited

U.S. PATENT DOCUMENTS 2,170,008 8/1939 Taylor et al. ..... 156/568

3,989,584 11/1976 Yamada ..... 156/571

4,256,528 3/1981 Patterson ..... 156/514

4,394,898 7/1983 Campbell ..... 271/185

*Primary Examiner*—Frederick R. Schmidt

*Assistant Examiner*—Robert Showalter

*Attorney, Agent, or Firm*—John D. Lister

[57] ABSTRACT

A machine for receiving a handle strip from a dispenser, rotating the strip to align it with a predetermined location on a moving carton blank, and applying the strip to the blank. A vacuum head for gripping the strips is carried by an arm mounted for rotation about a horizontal axis extending transversely of the moving blanks. The vacuum head is rotated through rotation of a pinion, which itself is rotated by a reciprocating rack. A cam follower mounted in a stationary cam causes the rack to reciprocate, thereby postively moving the rack in both directions.

6 Claims, 3 Drawing Sheets

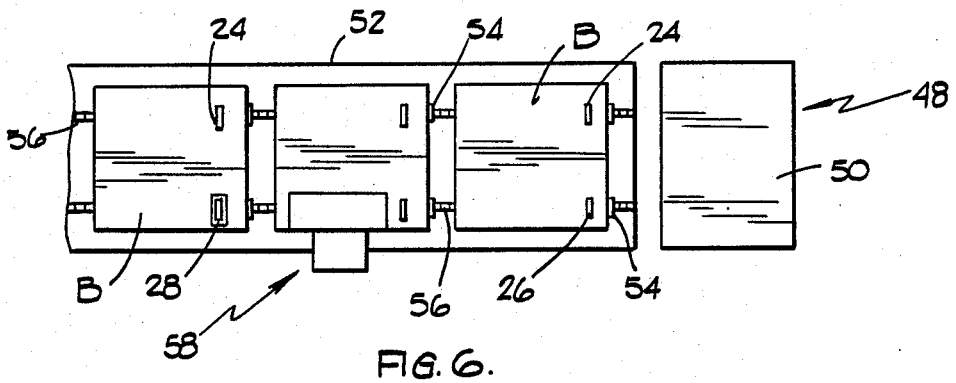
FIG. 6.
FIG 9.
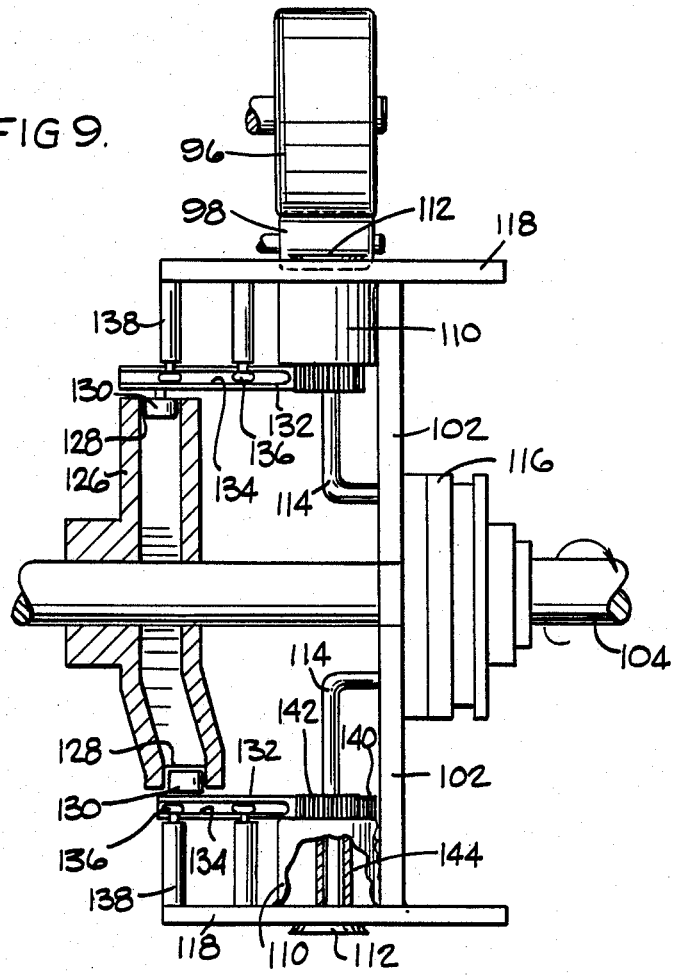

CARTON HANDLE APPLICATOR

FIELD OF THE INVENTION

This invention relates to a machine for applying a strip of material to a substrate. More particularly, it relates to a machine which positively moves the strip holding means through a series of motions for aligning and applying the strip at the proper location on the substrate.

BACKGROUND OF THE INVENTION

Certain types of products, particularly bulk products such as granulated soap, are commonly sold in large cartons provided with carrying handles. Because of the bulkiness and weight of the cartons the handles have to be especially strong, and thus preferably are not integrally formed from the carton blank. In one popular type of carton, for example, the handle consists of a separate strap which is glued to the carton in the packaging machine. Because the orientation of the blank for carton folding purposes requires that the handle be applied at right angles to the direction of movement of the carton blanks, it is necessary for the handle applicator to receive a handle, rotate it to the proper alignment, then apply it to the correct location on the blank, all at a speed which does not slow the flow of cartons through the high speed packaging machine.

This has been done in the past by a handle applicator which is rotated in one direction by a single direction cam, then returned to its original position by a return spring. This arrangement, however, creates problems. The spring return does not allow the turning apparatus to operate consistently as fast and as reliably as desired. Further, it tends to need more maintenance attention than a high speed machine should require.

It would therefore be desirable to provide an improved handle applicator which is more reliable than the type previously used. To do away with the single direction cam and spring return design, however, is made difficult by the lack of space available for the turning apparatus of the handle applicator and by the extremely high speeds at which the equipment must operate. It is made even more difficult by the requirement that the mechanism be relatively maintenance-free.

BRIEF SUMMARY OF THE INVENTION

This invention provides a turning apparatus which makes use of a rotatable gear connected to the strip holding means so that the strip holding means rotates with the rotation of the gear. The gear is caused to rotate a predetermined amount during rotation of the arm means on which the strip holding means is mounted.

In a preferred embodiment the gear is caused to rotate by a rack which is positively reciprocated by a cam arrangement wherein a cam follower attached to the rack is given reciprocating motion by a stationary cam in which the follower rides. The design of this arrangement allows the strip applicator to operate at high speeds and still be relatively maintenance-free due to the positive action of the cam, even though the allotted space does not appear to offer enough room for a device of this type to function.

Other features and aspects of the invention, as well as it various benefits, will be made clear in the more detailed description of the invention which follows.

BRIEF DESCRIPTION OF THE DRAWINGS

FIG. 6 is a schematic plan view of the portion of a carton packaging machine where the handle applicator is located;

FIG. 9 is a side view of the rotating arm and cam mechanism, with the cam being shown in section to illustrate the cam track in which the follower rides, and the lower housing wall being broken away to show the shaft to which the pinion gear and vacuum cup are attached.

DESCRIPTION OF THE INVENTION

Figure 1:
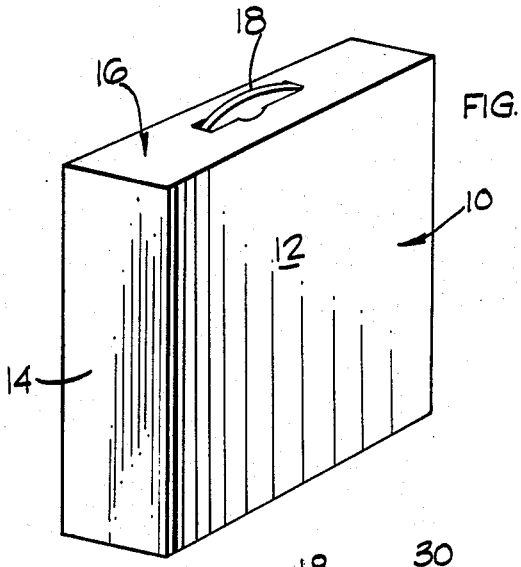
FIG. 1 is a pictorial view of a carton provided with a handle of the type which the apparatus of this invention is designed to apply to the carton blank.

Referring to FIG. 1, a carton 10 having a front panel 12, a side panel 14 and a top panel 16 is shown with a handle 18 extending up from the central portion of the top panel. The carton obviously also has a back panel, a bottom panel and another side panel, none of which are visible in this view.

Figure 2:
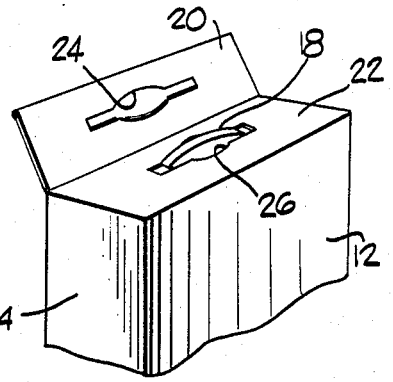
FIG. 2 is a partial pictorial view of the carton of FIG. 1 with the outer top panel flap open.

As shown in FIG. 2, the top panel 16 is comprised of an outer top panel flap 20 and an inner top panel flap 22. Although the outer top panel flap 20 is shown open for purpose of illustration, it is to be understood that it is normally adhered to the inner top panel flap 22 by glue. The outer top panel flap 20 has an opening or cutout 24 through which the handle 18 extends. The inner top panel flap 22 also has a similar opening 26 aligned with the opening 24 when the outer top panel flap overlaps the inner top panel flap to form the top panel 16. As can be seen, the handle 18 extends upwardly through both openings 24 and 26.

Figure 3:
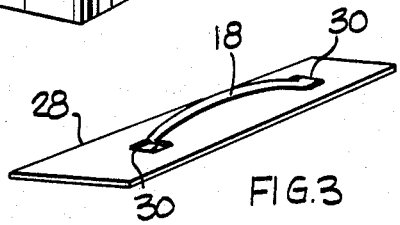
FIG. 3 is a pictorial view of the handle connected to the carton of FIG. 1, shown with its attached support strip.

The handle 18 is shown in FIG. 3 as comprising a strap or loop which is secured to a support strip 28 in any suitable manner. One common handle arrangement includes apertures 30 in the support strip through which the ends of the strap extend. The ends of the strap in such an arrangement are usually held in place against the underside of the strip 28 by a length of tape.

Figure 4:
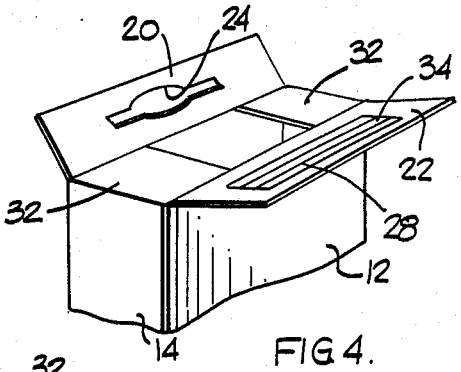
FIG. 4 is a partial pictorial view similar to that of FIG. 2, but showing the carton with both top panel flaps open.

The carton is shown in FIG. 4 with both outer and inner top panel flaps open in order to further illustrate the handle arrangement. The dust flaps 32, to which the inner top panel flap 22 is glued when forming a closed carton, are shown in their folded condition. The underside of the support strip 28 is shown in this view, with the tape 34 used to hold the ends of the handle strap in place being visible. The support strip is adhered to the inner surface of the inner top panel flap by glue and is centrally arranged so that the handle portion 18 extends out through the opening 26 in the inner top panel flap.

Figure 5:
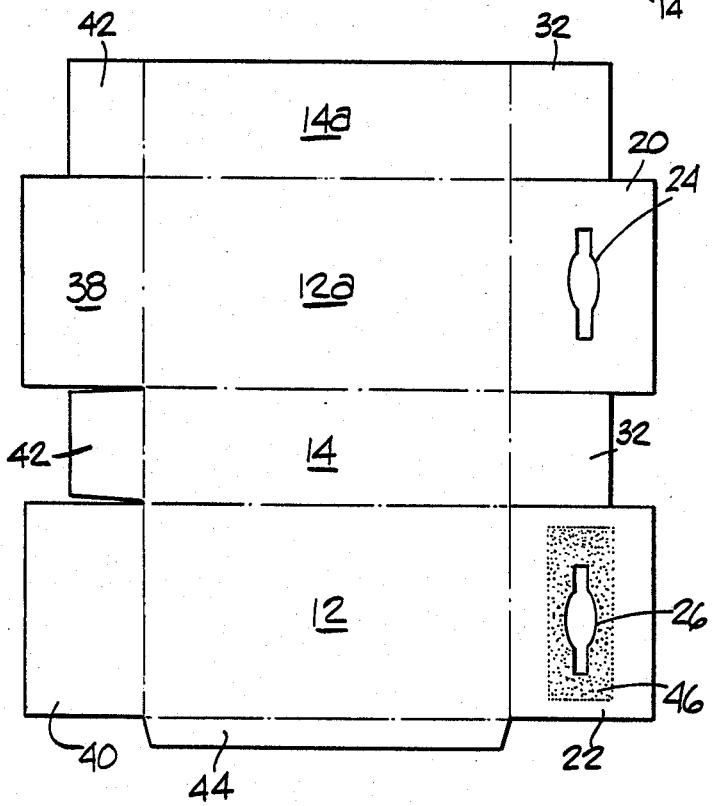
FIG. 5 is a plan view of the inside surface of a blank adapted to be formed into the carton of FIG. 1.

The carton of FIG. 1 is formed from the blank 36 shown in FIG. 5, the inside surface of which is facing the viewer. In the blank, sections 12 and 12*a* correspond to the front and back panels of the carton, sections 14 and 14*a* correspond to the side panels of the carton, and sections 20 and 22 correspond to the outer and inner top panel flaps, respectively, of the carton. In addition, sections 32 corresponding to the dust flaps 32 are shown, and sections 38, 40 and 42 corresponding to the bottom panel flaps and bottom dust flaps of the carton, are also shown, A glue strip 44 foldably connected to the front panel 12 is adhered to the section 14*a* when forming the blank into a carton. The stippled area 46 surrounding the handle opening 26 in the inner top panel section 22 indicates the portion of the inner surface of the section 22 to which the outer face of the support strip 28 is glued. It is to this precise location that the strip 28 must be delivered as the carton blanks are moved at high speed through the packaging machine.

The portion of the packaging machine 48 that performs the functions to which this invention pertains is shown schematically in FIG. 6. A production blank hopper and delivery station 50 located at the upstream end of the machine deposits blanks B onto a support bed 52. The handle apertures 24 and 26 are shown in the blanks to illustrate the orientation of the blanks on the support bed. Lugs 54, carried by spaced continuous chains 56 and extending up through slots in the support bed, engage the trailing edges of the blanks to push the blanks downstream over the surface of the support bed. A handle support strip hopper and application station 58 overlies the portion of the support bed over which the apertures 26 of the blanks B travel so that the support strips can be applied at the correct location. Note that the aperture 26 in the blank B at the far left side of FIG. 6 has been covered with a support strip 28.

Figure 7:
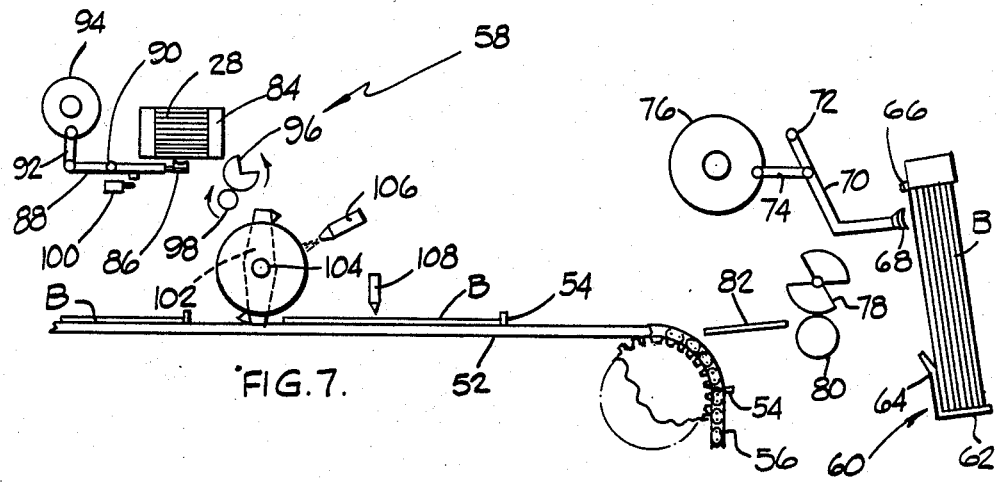
FIG. 7 is a side view of the packaging machine of FIG. 6, showing the carton blank and handle support strip feeding means.

Referring to FIG. 7, which shows the machine of FIG. 6 in somewhat more detail, the blanks B are shown stacked on edge in hopper 60, which includes support plates 62 and 64. The top edge of the next blank to be removed from the hopper is supported by a flange 66 which extends down over the top edge of the blank only a very short distance. Located just downstream from the hopper 60 is a suction head 68 mounted on angled arm 70 which is pivotally mounted at 72. The arm 70 is connected by link 74 to wheel 76 of a crank mechanism so that upon rotation of the wheel 76 the oscillating motion of the angled arm 70 causes the suction head 68 to reciprocate toward and away from the hopper 60. Engagement of the reciprocating suction head with the leading blank B will pull the blank with enough force to flex it past the short flange 66. The suction is then cut off and the leading edge of the blank drops into the nip of segmented roll 78 and backer roll 80. The segmented roll 78 is a driven roll while the backer roll 80 may be freely rotatable.

In operation, the segments of the roll 78 are spaced such that they are not in engagement with the backer coil while a blank is being pulled from the hopper 60 by the vacuum head. When the vacuum is cut off a segment of the roll 78 engages the leading edge portion of the blank and in combination with the backer roll 80 propels the blank downstream. The blank is supported during this movement by a support plate 82 which directs the blank to the support bed 52 of the packaging machine. The arrangement described thus far in connection with FIG. 7 is merely typical of the manner in which blanks can be fed from a hopper to the packaging machine. It should therefore be understood that other means of accomplishing the same thing may be employed instead if desired.

Still referring to FIG. 7, the handle support strip hopper and application station 58 comprises a hopper 84 in which the support strips 28 are stacked. The strips are supported in the hopper adjacent their ends, leaving a relatively large expanse of the body of the lowermost strip in the hopper exposed. A vacuum head 86 is positioned adjacent to and below the hopper 84 and is carried by lever arm 88. The lever arm 88 is pivotally mounted intermediate its ends at 90 and is pivotally attached at its downstream end to link 92. The link 92 is pivotally attached to the wheel 94 of a crank mechanism so that, similar to the operation of the blank dispensing apparatus, the vacuum head 86 moves toward and away from the hopper 84 upon rotation of the wheel 94 and the resulting oscillation of the lever arm 88. The vacuum head 86 thus contacts the bottom surface of the lowermost support strip 28 and, because the strip is formed of quite flexible paper or paperboard, pulls the lowermost strip from the hopper. The strip is then engaged by a segmented drive roller 96 which, in cooperation with backer roller 98, feeds the strip in an upstream direction. The vacuum to the head 86 would be cut off so as to release the strip when the segmented portion of the drive roll 96 engages the strip. This can be done by any suitable arrangement, such as by controlling the suction through switch 100, which would be actuated by the motion of the lever 88. As in the case of the blank dispensing and feeding means, the handle support strip dispensing and feeding means just described is simply illustrative of a typical way of removing the support strips from their hopper and presenting them to the rotating arm 102 of the strip application mechanism.

The arm 102, which is mounted on driven shaft 104 and rotates therewith, receives the support strip from the feed rolls 96 and 98. Because the support strip is aligned at this time with the length of the machine, it is necessary for the rotating arm mechanism to further turn or rotate the support strip so that it extends crosswise of the support bed as shown at 28 in FIG. 6. Just prior to such turning action, however, the support strip is sprayed with suitable adhesive from applicator 106, and at about the same time the area surrounding the aperture 26 in the blank B is sprayed with adhesive from applicator 108. Although it is preferred to apply adhesive to both the support strip and the blank as a means of ensuring complete binding contact, obviously a single application of adhesive on either the support strip or the blank could be used if found to perform satisfactorily.

Figure 8:
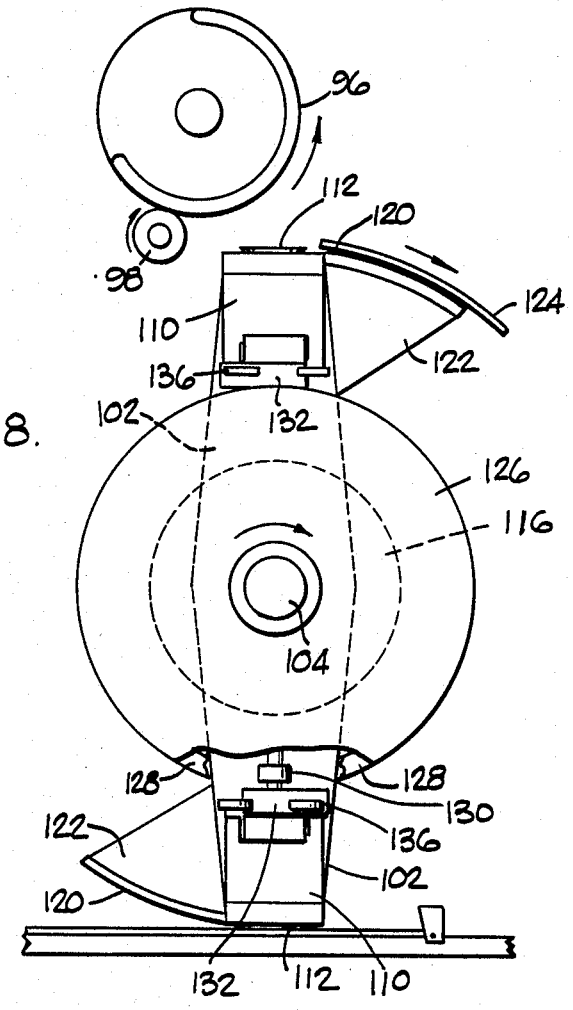
FIG. 8 is an end view of the rotating arm and cam mechanism, with the lower portion of the cam broken away to reveal the cam follower and the cam track.

Referring now to FIGS. 8 and 9, the rotating arm 102 carries a cylindrical housing 110 at each end. The housings are attached to the arm by any suitable means such as by welding. A vacuum cup 112 is contained in each of the housings 110 and extends therefrom a short distance. Connected to the vacuum cups are vacuum lines 114 extending from a rotary vacuum valve 116 mounted on the shaft 104. Surrounding each vacuum cup 112 is a plate 118 extending a substantial distance transversely of the support bed, as best shown in FIG. 9, which provides support for the strip at the time when the strip is transversely oriented. As best shown in FIG. 8, the plates 118 have an arcuate extension 120 connected to the arm 102 by supports 122. the arcuate extension 120 is on the leading side of the plate 118 as the plate moves with the rotating arm 102. Positioned a short distance upstream from the rolls 96 and 98 so as to be slightly upwardly spaced from the path of the plates 118 is a handle strip guide 124.

Fixedly mounted and supported by support structure, not shown, is stationary cam 126 in which the shaft 104 is journaled. The cam contains a cam track 128 in which cam followers 130 ride. The cam followers are connected to an elongated guide member 132 having grooves 134 in its sides for receiving guide rollers 136. The guide rollers 136 may be supported by the plates 118 by any suitable means, such as by support posts 138. The opposite end of the guide member 132 contains a rack 140 which is in engagement with a pinion gear 142. The pinion gear 142 is connected to a shaft 144 which is also connected to the vacuum cup 112, the vacuum line 114 extending through the hollow shaft 144 to connect to the vacuum cup.

In operation, as a handle support strip is fed through the rolls 96 and 98, one of the vacuum cups 112 will have rotated into position to grip the underside of the strip. The strip at this point is partially supported on the arcuate extension 120 and the strip guide 124 will have deflected the strip if necessary to arrange the strip in its intended position on the extension 120. The cam follower 130 at this point is held by the cam track 128 so that the rack 140 is in its fully retracted position, substantially hidden behind the pinion gear 142 at the top of FIG. 9. As the arm 102 continues to rotate, the cam follower is moved until the rack is in its fully extended position shown at the bottom of FIG. 9. Movement of the rack rotates the pinion gear 142, which rotates the shaft 144 and attached vacuum cup 112 an amount sufficient to rotate the strip 28 held by the vacuum cup so that the strip is in the correct position by the time it reaches the moving blank on the support bed of the machine.

Although a vacuum cup rotating mechanism has been shown as being carried at both ends of the rotating arm 102, it should be understood that the vacuum cup need be provided on only one end of the arm, if desired, depending upon the speed of the packaging machine and the size of the blanks.

It can be seen that the mechanism for rotating the vacuum cups does so in a positive manner, resulting in a first precise rotational movement to properly orient the strip and a second precise rotational movement to place the vacuum cup in proper position to receive another strip. Not only are the rotational movements accurate, but they are carried out very rapidly and in a very limited space. Because there are few moving parts in the mechanism and because the movements involved are so tightly controlled by the positive cam action, the operation is both reliable and relatively maintenance-free.

It should be obvious that although a preferred embodiment of the invention has been disclosed, changes to certain of the details of the embodiment may be made without departing from the spirit and scope of the invention as defined in the claims.

What is claimed is:

1. A machine for applying an elongated strip of material to a moving substrate at a predetermined location thereon, comprising:

a generally horizontal support bed;

means for moving a series of substrates on the support bed in a downstream direction;

arm means mounted for rotation about a generally horizontal axis located above and extending transversely of the support bed, the arm means having an end portion extending closely adjacent to the substrate as the arm means rotates;

means on the end portion of the arm means for holding an elongated strip of material so that the strip contacts the substrate as the arm means rotates;

means for feeding an elongated strip of material to the strip holding means at a location remote from the support bed so that the strip is at an angle to the predetermined location on the substrate;

a rotatable gear connected to the strip holding means so that the strip holding means rotates therewith, the gear being rotatable about an axis transverse to the axis of rotation of the arm means;

a rack mounted for reciprocal movement in a direction parallel to the axis of rotation of the arm means, the rack being operatively connected to the rotatable gear; and a stationary cam having a track for receiving a cam follower, a cam follower carried by the arm means and operatively engaging the cam track, the cam follower being connected to the rack, the configuration of the cam track being such that upon rotation of the arm means the cam follower will positively reciprocate the rack to cause the rotatable gear to rotate to a position whereby when the strip comes into contact with the substrate the strip will be aligned with the predetermined location on the substrate.

2. In a machine for applying an elongated strip of material to a moving substrate, wherein the machine comprises:

means for moving a series of substrates along a generally horizontal support bed;

arm means mounted for rotation about a generally horizontal axis located above and extending transversely of the direction of the support bed, the extremity of the arm means being closely adjacent to the substrate as the arm means rotates past the support bed;

vacuum means on the end of the arm means for holding an elongated strip of material, the location of the vacuum means being such that the strip contacts the substrate as the arm means rotates; and means for feeding an elongated strip of material to the vacuum holding means at a location remote from the support bed so that the strip is at an angle to the predetermined location on the substrate;

the improvement comprising:

a rotatable gear connected to the vacuum holding means so that the vacuum holding means rotates therewith, the gear being rotatable about an axis transverse to the axis of rotation of the arm means; and cam means operatively connected to the rotatable gear for rotating the gear a predetermined distance in one angular direction during rotation of the arm means, whereby when the strip comes into contact with the substrate the strip will be aligned with the predetermined location on the substrate;

the cam means, after the strip has been brought into contact with the substrate, causing the rotatable gear to rotate the same predetermined distance in the opposite angular direction to return the vacuum holding means to the position it was in at the location of the strip feeding means;

the cam means including a cam follower carried by the arm means, the cam follower being operatively connected to a reciprocally mounted rack, the rack being mounted for movement in a direction parallel to the axis of rotation of the arm means and being in engagement with the rotatable gear, whereby movement of the rack causes rotational movement of the rotatable gear.

3. A machine according to claim 2, wherein the rack is mounted on the end portion of a reciprocally mounted guide arm, the cam follower being connected to the guide arm, the operative connection between the cam follower and the rack further including guide rollers contacting opposite sides of the guide arm to hold the guide arm in proper alignment as the guide arm is reciprocated by the movement of the cam follower.

4. A machine according to claim 2, wherein the cam means comprises a stationary cam having a track in which the cam follower rides, the configuration of the cam track being such that upon rotation of the arm means the cam follower will be moved by the cam track to reciprocate the rack to rotate the rotatable gear first in one angular direction and then in the opposite angular direction.

5. A machine according to claim 4, wherein the arm means includes a plurality of arms, each arm having similar vacuum holding means and operatively connected cam follower, rack and rotatable gear.

6. A machine according to claim 5, wherein the substrate is a carton blank and the elongated strip is a handle means for lifting a carton formed from the blank.

* * * * *